US010259033B2

(12) United States Patent
Yousefiana

(10) Patent No.: US 10,259,033 B2
(45) **Date of Patent: *Apr. 16, 2019**

(54) METHOD FOR PRODUCTION OF PERFORMANCE ENHANCED METALLIC MATERIALS

(71) Applicant: The Boeing Company, Chicago, IL (US)

(72) Inventor: Ali Yousefiana, Arcadia, CA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/386,509

(22) Filed: Dec. 21, 2016

(65) Prior Publication Data

US 2017/0297081 A1 Oct. 19, 2017

Related U.S. Application Data

(63) Continuation of application No. 14/102,753, filed on Dec. 11, 2013, now Pat. No. 9,561,538.

(51) Int. Cl.

| | |
|---|---|
| ***C21D 7/00*** | (2006.01) |
| ***C22F 1/04*** | (2006.01) |
| ***B21J 7/16*** | (2006.01) |
| ***B22F 3/16*** | (2006.01) |
| ***C22C 1/04*** | (2006.01) |

(Continued)

(52) U.S. Cl.

CPC ..... *B21J 7/16* (2013.01); *B21C 29/003* (2013.01); *B22F 3/02* (2013.01); *B22F 3/12* (2013.01); *B22F 3/16* (2013.01); *B22F 3/172* (2013.01); *B22F 3/20* (2013.01); *B22F 9/04* (2013.01); *C21D 7/00* (2013.01); *C22C 1/0416* (2013.01); *C22F 1/04* (2013.01); *B22F 9/082* (2013.01);

(Continued)

(58) Field of Classification Search

None

See application file for complete search history.

(56) References Cited

U.S. PATENT DOCUMENTS

| | | | |
|---|---|---|---|
| 4,599,241 | A | 7/1986 | Nakaboh et al. |
| 5,615,465 | A | 4/1997 | Broussoux et al. |

(Continued)

FOREIGN PATENT DOCUMENTS

| | | | |
|---|---|---|---|
| CN | 101812628 | A1 | 8/2010 |
| CN | 102091859 | A1 | 6/2011 |

(Continued)

OTHER PUBLICATIONS

State Intellectual Property Office of PRC, Notification of First Office Action, Appln. No. 201410754213.3 (dated Sep. 30, 2017).

(Continued)

*Primary Examiner* — George Wyszomierski

(74) *Attorney, Agent, or Firm* — Walter & Wasylyna LLC

(57) ABSTRACT

A method for production of a metallic material from a semifinished metallic billet, the semifinished metallic billet including a nanocrystalline microstructure and/or an ultra-fine-grained microstructure, the method including the steps of (1) subjecting the semifinished metallic billet to a rotary incremental forming process to form an intermediate wrought metallic billet, and (2) subjecting the intermediate wrought metallic billet to a high rate forming process to form a metallic product.

23 Claims, 3 Drawing Sheets

(51) Int. Cl.

| | |
|---|---|
| ***B22F 3/17*** | (2006.01) |
| ***B22F 3/20*** | (2006.01) |
| ***B21C 29/00*** | (2006.01) |
| ***B22F 3/02*** | (2006.01) |
| ***B22F 3/12*** | (2006.01) |
| ***B22F 9/04*** | (2006.01) |
| *B22F 9/08* | (2006.01) |

(52) U.S. Cl.
CPC ..... *B22F 2998/10* (2013.01); *B22F 2999/00* (2013.01)

(56) References Cited

U.S. PATENT DOCUMENTS

| | | | | |
|---|---|---|---|---|
| 9,561,538 | B2 * | 2/2017 | Yousefiani | B22F 3/172 |
| 2005/0133121 | A1 | 6/2005 | Subramanian et al. | |
| 2005/0147520 | A1 | 7/2005 | Canzona | |
| 2011/0061494 | A1 | 3/2011 | Pandey | |
| 2014/0225042 | A1 * | 8/2014 | In | B22F 1/0022 252/503 |

FOREIGN PATENT DOCUMENTS

| | | |
|---|---|---|
| JP | S51-060608 | 5/1976 |
| JP | 2006-274323 | 10/2006 |
| WO | WO2013002272 A1 | 1/2013 |

OTHER PUBLICATIONS

R. Mateus et al., Microstructural Characterization of the ODS Eurofer 97 EU-bach, Fusion Engineering and Design, vol. 86 issues 9-11, pp. 2386-2389 (Feb. 2011) pp. 19-22.
B.Q.Han et al., Deformation Behavior of Bimodal Nanostructured 5083 A1 Alloys, Metallurigical and Materials Transactions A, vol. 36 issue 4, pp. 957-965 (Apr. 2005) pp. 23-31.
Li Jiongli et al., The Chinese Journal of Nonferrous Metals, Preparation of Super High Strength bulk Nanocrystalline, vol. 23, Issue 5, pp. 1182-1188 (May 30, 2013).
Wang Erde et al., Powder Metallurgy Technology, Research Progress in W—Ni—Fe Tungsten Heavy Alloys by Deformation Strengthening Processing, vol. 22, Issue 5, pp. 303-307 (Oct. 31, 2004).
Kaka Ma, et al. Acta Materialia, Mechanical Behavior and Strengthening Mechanisms in Ultrafine, vol. 62, pp. 141-155 (Oct. 24, 2013).
European Patent Office, "Communication pursuant to Article 94(3) EPC," App. No. 14196631.7 (dated May 30, 2018).
State Intellectual Property Office of PRC, Notification of Second Office Action, Appln. No. 201410754213.3 (dated May 9, 2018) (including English translation).
Japanese Patent Office, Office Action, with English translation, App. No. 2014-243950 (dated Oct. 30, 2018).

* cited by examiner

METHOD FOR PRODUCTION OF PERFORMANCE ENHANCED METALLIC MATERIALS

PRIORITY

This application is a continuation of U.S. Ser. No. 14/102,753 filed on Dec. 11, 2013.

FIELD

This application relates to the production of metallic materials and, more particularly, to the production of performance enhanced metallic materials, such as metals, metal alloys, intermetallics and metal matrix composites.

BACKGROUND

There is a critical and ever-growing need for metallic materials with significantly enhanced properties, such as yield and ultimate strength, fracture toughness, fatigue strength, resistance to tribological and environmentally-assisted damage, machinability, formability and joinability, when compared to current state of the art metallic materials. The goal is to improve cost, delivery and reliability of components in commercial and military aircraft, satellites, weapons, electronic and defense systems, spacecraft and launch systems.

For example, the cost of fuel is a significant economic factor in the operation of commercial vehicles, such as passenger aircraft and cargo aircraft. Therefore, aircraft designers and manufacturers continue to seek methods to improve the overall fuel efficiency of aircraft and, thus, reduce overall aircraft operating expenses. One well-established technique for increasing fuel efficiency, as well as enhancing overall aircraft performance, is reducing the structural weight of the aircraft. This is accomplished by designing various structural components of an aircraft using materials with high strength-to-weight ratio, such as aluminun titanium and magnesium alloys, thereby reducing the overall structural weight of the aircraft and, thus, increasing fuel economy.

Nanocrystalline (NC) and ultrafine grained (UFG) metallic materials have shown promise of meeting the aforementioned goals for enhanced performance. They are routinely being synthesized at laboratory scale and major advancements have been made in understanding their behavior. However, excitement brought about by the potential of bulk NC/UFG metallic materials, especially as a result of their very high strength, has been tempered by their disappointingly low ductility and toughness, limiting most engineering applications of NC/UFG metallic materials. Additionally, commercial application of NC/UFG metallic materials beyond laboratory boundaries depends strongly on the successful consolidation and/or thermomechanical processing of these materials into bulk components while preserving their nanocrystalline and/or ultra fine grain size. Grain growth, which is a result of the poor thermal stability of NC/UFG metallic materials, severely limits such critical processing steps.

Accordingly, those skilled in the art continue with research and development efforts in the field of metallic material production and, particularly, production of performance enhanced metallic materials.

SUMMARY

In one embodiment, disclosed is a method for production of a metallic material from a semifinished metallic billet, the semifinished metallic billet including a nanocrystalline microstructure and/or an ultrafine-grained microstructure, the method including the steps of (1) subjecting the semifinished metallic billet to a rotary incremental forming process to form an intermediate wrought metallic billet, and (2) subjecting the intermediate wrought metallic billet to a high rate forming process.

In another embodiment, disclosed is a method for production of aluminum alloys, the method may include the steps of: (1) providing a semifinished aluminum alloy billet, the semifinished aluminum alloy billet including a nanocrystalline microstructure and/or an ultrafine-grained microstructure, (2) subjecting the semifinished aluminum alloy billet to a rotary swaging process to form an intermediate wrought aluminum alloy product, and (3) subjecting the intermediate wrought aluminum alloy product to a high rate extrusion process.

In yet another embodiment, disclosed is a method for production of a metallic material, the method may include the steps of: (1) providing a metallic material powder, (2) subjecting the metallic material powder to a cryomilling process to form a cryomilled metallic material powder having a nanocrystalline microstructure and/or an ultrafine-grained microstructure, (3) subjecting the cryomilled metallic material powder to a degassing process to form a degassed metallic material powder, (4) subjecting the degassed metallic material powder to a consolidating process, such as a hot isostatic pressing process, to form a semifinished metallic billet, the semifinished metallic billet comprising the nanocrystalline and/or ultrafine-grained microstructure, (5) subjecting the semifinished metallic billet to a rotary incremental forming process to form an intermediate wrought metallic product, and (6) subjecting the intermediate wrought metallic product to a high rate forming process.

Other embodiments of the disclosed method for production of metallic materials will become apparent from the following detailed description, the accompanying drawings and the appended claims.

DETAILED DESCRIPTION

Figure 1:
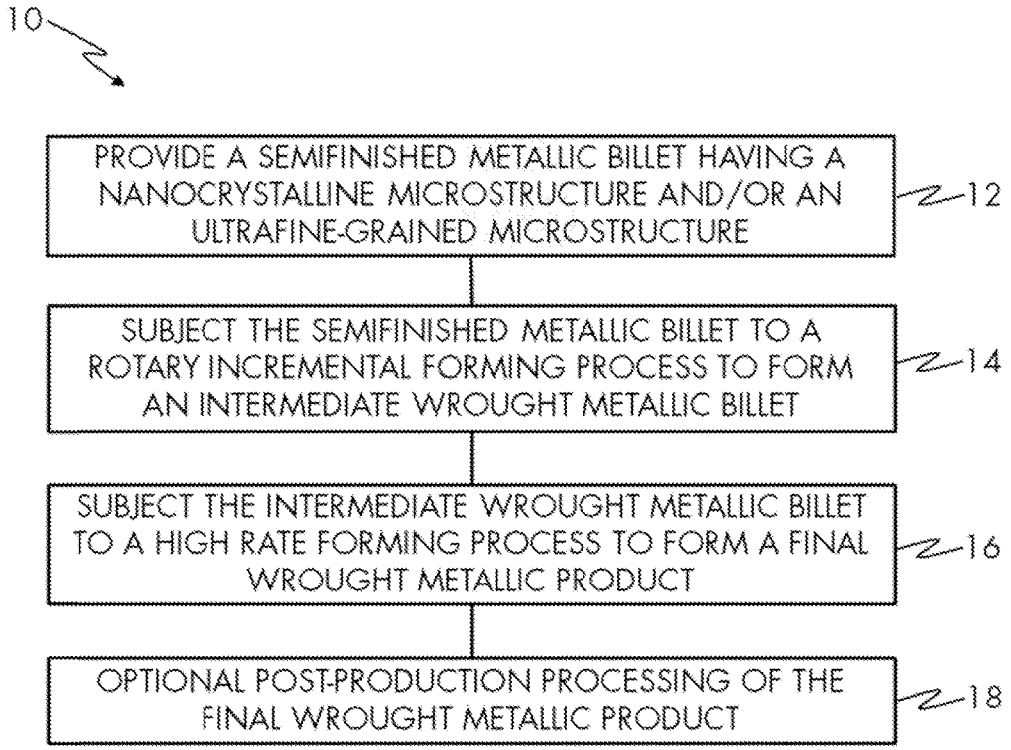
FIG. 1 is a flow chart depicting one embodiment of the disclosed method for production of performance enhanced metallic materials.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Referring to FIG. 1, disclosed is one embodiment of a method, generally designated 10, for production of performance enhanced metallic materials. The method 10 may include one or more thermomechanical processes configured to produce high performance or ultrahigh performance metallic materials, such as metal products, metal alloy products, intermetallic products, and metal matrix composites, for example in wrought form.

As used herein, "high performance" refers to a 20 percent to 50 percent improvement in target properties when compared to conventional micrograined state of the art material with similar composition. "Ultrahigh performance" refers to at least 50 percent improvement in target properties when compared to conventional micrograined state of the art material with similar composition.

As shown in block 12, the method 10 may begin with the step of providing a semifinished metallic billet. The semifinished metallic billet may include a nanocrystalline microstructure, an ultrafine-grained microstructure, or both a nanocrystalline and ultrafine-grained microstructure.

The semifinished metallic billet may be formed from various metallic materials or combinations of materials. For example, the semifinished metallic billet may be formed from or may include aluminum, aluminum alloys, titanium, titanium alloys, iron-based alloys (e.g., carbon and alloy steels, tool steels, and stainless steels), superalloys (e.g., nickel, nickel alloys, cobalt, and cobalt alloys), refractory metals, refractory alloys, magnesium, magnesium alloys, copper, copper alloys, precious metals, precious metal alloys, zinc, zinc alloys, zirconium, zirconium alloys, hafnium, hafnium alloys, intermetallics, and metal matrix materials for composites.

The semifinished metallic billet may be produced by any suitable method. As one general example, the semifinished metallic billet may be formed by consolidating small nanocrystalline/ultrafine-grained clusters. As another general example, the semifinished metallic billet may be formed by breaking down microcrystalline units. Specific, but non-limiting, techniques for producing the semifinished metallic billet include inert gas condensation; electrodeposition; mechanical alloying; cryomilling; crystallization from amorphous metallic material; severe plastic deformation; plasma synthesis; chemical vapor deposition; physical vapor deposition; sputtering; pulse electron deposition; spark erosion; and the like.

As shown at block 14, the semifinished metallic billet (e.g., a semifinished aluminum alloy billet) may be subjected to a rotary incremental forming process or operation (e.g., a primary thermomechanical process) configured to shape and/or form (e.g., reduce the cross-sectional area) the semifinished metallic billet into an intermediate wrought metallic billet (e.g., an intermediate wrought aluminum alloy billet). The rotary incremental forming process may include a rotary swaging process, a rotary forging process, a rotary piercing process, a rotary pilgering process, and the like. As a specific example, the semifinished metallic billet may be subjected to a hot rotary swaging process to produce the intermediate wrought metallic billet having a cross-sectional area smaller than the cross-sectional area of the semifinished metallic billet.

The rotary incremental forming process may include one or more rotary incremental forming process parameters, such as a rotary incremental forming process temperature, rotary incremental forming process average equivalent strain rate and a rotary incremental forming process reduction ratio. As a specific example, a hot rotary swaging process may be performed by any suitable rotary swaging apparatus operating under swaging processing parameters (e.g., rotary incremental forming process parameters). The semifinished metallic billet may be shaped at a swaging temperature. The rotary swaging apparatus may operate at a spindle rotation speed and the semifinished metallic billet may be reduced by a reduction percentage per rotation (e.g., pass) of the forging dies of the rotary swaging apparatus and may be processed at a feed rate (e.g., feed speed) through the rotary swaging apparatus (e.g., the rotary incremental forming process reduction ratio). The rotary swaging process may be performed using a commercially available rotary swaging machine.

In one realization, the rotary incremental forming process temperature (in degrees Kelvin) may be a function of the melting temperature $T_M$ (in degrees Kelvin) of the semifinished metallic billet. As one example, the rotary incremental forming process temperature may range from about 5° K to about 20 percent of the melting temperature $T_M$ of the semifinished metallic billet. As another example, the rotary incremental forming process temperature may range from about 20 to about 40 percent of $T_M$. As another example, the rotary incremental forming process temperature may range from about 40 to about 60 percent of $T_M$. As another example, the rotary incremental forming process temperature may range from about 60 to about 90 percent of $T_M$. As yet another example, the rotary incremental forming process temperature may be at most about 90 percent of $T_M$.

In one example implementation, the rotary incremental forming process reduction ratio (e.g., ratio of the initial cross-sectional area to the final cross-sectional area) may be greater than 10:1. In another example implementation, the rotary incremental forming process reduction ratio may range from about 10:1 to about 5:1. In yet another example implementation, the rotary incremental forming process reduction ratio may range from about 5:1 to about 1.5:1.

During the rotary incremental forming process, the semifinished metallic billet may experience an average equivalent strain rate that depends on a variety of factors, including the composition of the semifinished metallic billet. In one expression, the rotary incremental forming process average equivalent strain rate may range from about 0.00001 $s^{-1}$ to about 0.01 $s^{-1}$. In another expression, the rotary incremental forming process average equivalent strain rate may range from about 0.01 $s^{-1}$ to about 1 $s^{-1}$. In another expression, the rotary incremental forming process average equivalent strain rate may range from about 1 $s^{-1}$ to about 100 $s^{-1}$. In yet another expression, the rotary incremental forming process average equivalent strain rate may be at most about 100 $s^{-1}$.

As shown at block 16, the intermediate wrought metallic billet (e.g., the intermediate wrought aluminum alloy billet) may be subjected to a high rate forming process (e.g., a secondary thermomechanical process) configured to produce a final wrought metallic product (e.g., a final wrought aluminum alloy product). The high rate forming process may include extrusion, drawing, forging, rolling, and the like. As a general example, the intermediate wrought metallic billet may be subjected to an extrusion process to produce the final wrought metallic product in wrought form (e.g., rods, sheets, bars, or plates). As a specific example, the intermediate wrought metallic billet may be subjected to an ambient temperature extrusion process at a high strain rate to homogenize the microstructure of the intermediate wrought metallic billet and introduce the necessary texture to meet ultrahigh performance target requirements in the form of a final wrought metallic product.

The high rate forming process may include one or more high rate forming process parameters, such as a high rate forming process temperature, a high rate forming process average equivalent strain rate, and a high rate forming process reduction ratio. As a specific example, an ambient temperature extrusion process may be performed by any suitable extrusion apparatus operating under the high rate forming process parameters. The intermediate wrought metallic billet may be shaped at an extruding temperature. The extrusion process may operate at an extruding strain rate and at a punch speed to reduce the cross-sectional area of the intermediate wrought metallic billet per pass. The extrusion process may be performed using a commercially available extrusion machine.

In one realization, the high rate forming process temperature (in degrees Kelvin) may be a function of the melting temperature $T_M$ (in degrees Kelvin) of the semifinished metallic billet. As one example, the high rate forming process temperature may range from about 5° K to about 20 percent of the melting temperature $T_M$ of the semifinished metallic billet. As another example, the high rate forming process temperature may range from about 20 to about 40 percent of $T_M$. As another example, the high rate forming process temperature may range from about 40 to about 60 percent of $T_M$. As another example, the high rate forming process temperature may range from about 60 to about 90 percent of $T_M$. As yet another example, the high rate forming process temperature may be at most about 90 percent of $T_M$.

In one example implementation, the high rate forming process reduction ratio (e.g., ratio of the initial cross-sectional area to the final cross-sectional area) may be greater than 10:1. In another example implementation, the high rate forming process reduction ratio may range from about 10:1 to about 5:1. In yet another example implementation, the high rate forming process reduction ratio may range from about 5:1 to about 1.5:1.

During the high rate forming process, the intermediate wrought metallic billet may experience a relatively high average equivalent strain rate that depends on a variety of factors, including the composition of the intermediate wrought metallic billet. In one expression, the high rate forming process average equivalent strain rate may range from about 0.1 $s^{-1}$ to about 10 $s^{-1}$. In another expression, the high rate forming process average equivalent strain rate may range from about 10 $s^{-1}$ to about 1,000 $s^{-1}$. In yet another expression, the high rate forming process average equivalent strain rate may range from about 1,000 $s^{-1}$ to about 100,000 $s^{-1}$.

As shown at block 18, the final wrought metallic product may optionally be subjected to various post-production processing to form a final part or component. Non-limiting examples of post-production processes include machining, solid state bonding, forming, heat-treating and the like.

Thus, the method 10 may produce a high performance or an ultrahigh performance final wrought metallic product, as well as a part or component processed from the final wrought metallic product. The material performance characteristics (e.g., performance indexes) that may be increased by the disclosed method 10 may include yield and ultimate strength, fracture toughness, fatigue strength, resistance to tribological and environmentally-assisted damage, machinability, formability, and joinability, and the like. For example, the final wrought metallic product produced in accordance with the disclosed method 10 may include a yield strength at least 50 percent more than that of a traditional micro-grained metal product (e.g., a traditional micro-grained aluminum alloy product) with reasonable ductility of 5 percent or more.

Those skilled in the art will appreciate that varying one or more of the process parameters (e.g., the rotary incremental forming process parameters and/or the high rate forming process parameters) may impact one or more of the material performance characteristics of the final wrought metallic product.

Those skilled in the art will also appreciate that the flowchart shown in FIG. 1 illustrates functionality and operations of example embodiments and implementations of the disclosed method 10. In this regard, each block in the flowchart may represent an operation having various parameters and/or functions. It should also be noted that, in some embodiments and implementations, the operations depicted in the blocks may occur out of the order noted in the descriptions and figure. For example, the operations and/or functions of two blocks shown in succession may be executed substantially concurrently or the operations and/or functions of the blocks may sometimes be executed in an alternate order (e.g., reverse order), depending upon the particular process involved.

Optionally, while not shown in FIG. 1, various heat treatment steps may be performed in between the steps shown, such as in between blocks 12 and 14, in between blocks 14 and 16, and/or in between blocks 16 and 18.

Figure 2:
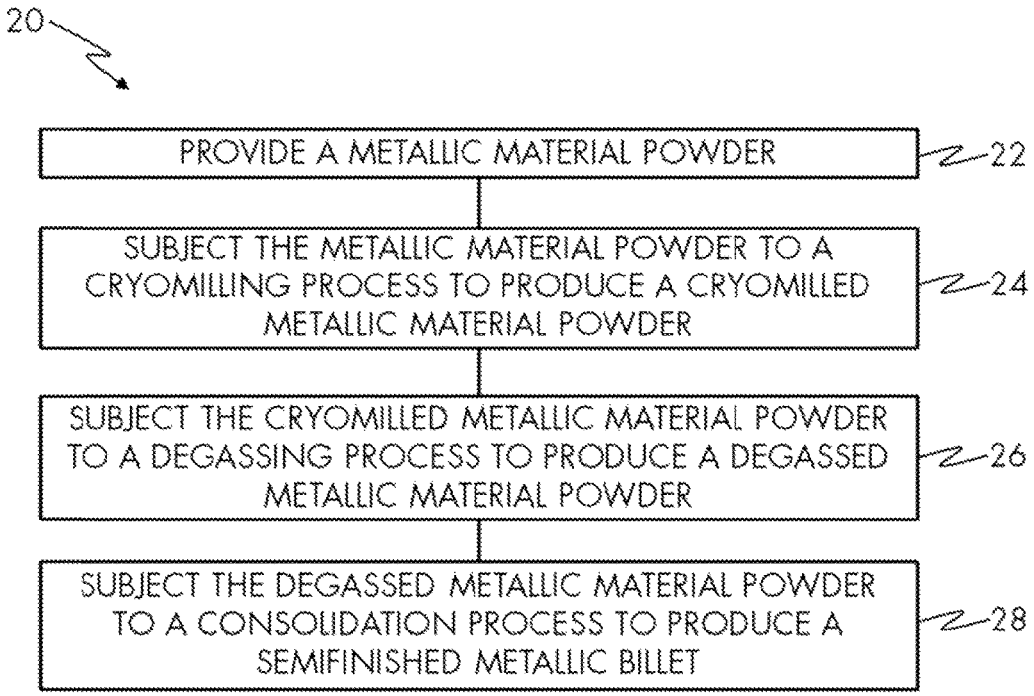
FIG. 2 is a flow chart depicting one example method for producing a semifinished metallic billet having a nanocrystalline microstructure and/or an ultrafine-grained microstructure.

Referring to FIG. 2, in one specific implementation, a semifinished metallic billet may be produced using the method 20 outlined in FIG. 2. The resulting semifinished metallic billet may have a nanocrystalline microstructure and/or an ultrafine-grained microstructure.

As shown in block 22, the method 20 may begin with the step of providing a metallic material powder. The type and chemistry of the metallic material powder may vary. Type may include spherical, sponge, flake and the like. Chemistry may include mixtures of microcrystalline elemental and/or prealloyed and/or partially alloyed powder that may be commercially available. For example, the metallic material powder may include one or more of the following: aluminum, aluminum alloys, titanium, titanium alloys, iron-based alloys (e.g., carbon and alloy steels, tool steels, and stainless steels), superalloys (e.g., nickel, nickel alloys, cobalt, and cobalt alloys), refractory metals, refractory alloys, magnesium, magnesium alloys, copper, copper alloys, precious metals, precious metal alloys, zinc, zinc alloys, zirconium, zirconium alloys, hafnium, hafnium alloys, intermetallics, and metal matrix materials for composites.

As a specific non-limiting example, a blend of aluminum alloy powder may include blends of atomized aluminum powders mixed with powders of various alloying elements such as zinc, copper, magnesium, silicon and the like.

As shown at block 24, the metallic material powder may be subjected to a mechanical milling process configured to produce a milled metallic powder. For example, the metallic material powder (e.g., a blend of aluminum alloy powder) may be subjected to a cryomilling process or another suitable cryogenic grinding process. The metallic material powder may be milled at a cryogenic temperature under processing parameters in order to attain a nanocrystalline ("NC") microstructure (e.g., a grain size of approximately between 1 nm to 100 nm) or an ultrafine-grained ("UFG") microstructure (e.g., a grain size of approximately 100 nm to 1000 nm).

The cryomilling process may be performed by any suitable cryogenic mechanical alloying or cryogenic grinding apparatus having an integral cooling system operating at the cryogenic temperature. For example, the cryomilling process may be performed using a commercially available cryomilling machine, such as a 01-S attritor with a stainless steel vial manufactured by Union Process, Inc., of Akron, Ohio.

The cryomilling process may include one or more cryomilling process parameters, such as a cryogenic temperature, a cryomilling time, a cyromilling media-to-powder weight ratio, and a cryomilling speed.

For example, the cryogenic temperature may be reached by milling the metallic material powder in a cryogen slurry (e.g., a bath of liquid nitrogen or liquid argon). The cryogenic temperature may be sufficient to slow recovery and recrystallization and minimize diffusion distances between the different components of the metallic material powder, which may lead to fine grain structures and rapid grain refinement.

In an example implementation, the cryogenic temperature may be less than or equal to −50° C. In another example implementation, the cryogenic temperature may be less than or equal to −100° C. In another example implementation, the cryogenic temperature may be less than or equal to −150° C. In another example implementation, the cryogenic temperature may be less than or equal to −196° C. In another example implementation, the cryogenic temperature may be less than or equal to −200° C. In another example implementation, the cryogenic temperature may be less than or equal to −300° C. In another example implementation, the cryogenic temperature may be less than or equal to −350° C. In yet another example implementation, the cryogenic temperature may be less than or equal to −375° C.

The cyromilling apparatus may include a milling media. For example, the cryomilling apparatus may be a high-energy mill having a stainless steel milling arm and a plurality of impact balls as the milling media. For example, the impact balls may include, but are not limited to, stainless steel balls, hardened steel balls, zirconium oxide balls, polytetrafluoroethylene ("PTFE") balls, and the like. The milling media (e.g., impact balls) may have any suitable or appropriate size hardness, and density.

The ratio of cryomilling media to metallic material powder may be any ratio suitable to adequately mill or grind the metallic material powder into a nanocrystalline or ultrafine-grained cryomilled metallic material powder (e.g., a cryomilled aluminum alloy powder). In an example implementation, the cryomilling media to metallic material powder weight ratio may be greater than about 32:1. In another example implementation, the cryomilling media-to-metallic material powder weight ratio may range from about 32:1 to about 15:1. In yet another example implementation, the cryomilling media-to-metallic material powder weight ratio may be less than about 15:1

The metallic material powder may be cryomilled for a time period (e.g., the cryomilling time) suitable to adequately mill or grind the metallic powder into a nanocrystalline or ultrafine-grained cryomilled metallic material powder. In an example implementation, the cryomilling time may be approximately 4 hours. In another example implementation, the cryomilling time may be approximately 8 hours. In another example implementation, the cryomilling time may be approximately 12 hours. In yet another example implementation, the cryomilling time may be between 8 and 12 hours. Longer cryomilling times are also contemplated.

The cryomilling speed (e.g., the attrition speed) may be any suitable speed sufficient to adequately mill or grind the metallic material powder into a nanocrystalline or ultrafine-grained cryomilled metallic material powder. In an example implementation, the cryomilling speed may be approximately 150 to approximately 200 revolutions per minute, such as about 180 revolutions per minute.

Optionally, additives may be applied to the metallic material powder during the cryomilling process. For example, one or more process control agents ("PCA") may be added to the metallic material powder during the cryomilling process. As a specific, non-limiting example, steric acid may be added. In an example implementation, about 0.1 to about 0.5 percent by weight (e.g., about 0.2 percent by weight) of stearic acid may be added.

Those skilled in the art will appreciate that the nanocrystalline microstructure or the ultrafine-grained microstructure of the cryomilled metallic material powder may depend upon the cryomilling parameters and the composition of the metallic material powder.

As shown at block 26, the cryomilled metallic material powder may be subjected to a degassing process configured to produce a degassed metallic material powder (e.g., a degassed aluminum alloy powder). For example, the cryomilled metallic material powder may be subjected to any appropriate degasification process suitable to remove (e.g., minimize) any entrapped gasses (e.g., water, hydrogen, and other hydrated compounds) that may be adsorbed on the cryomilled metallic material powder during the cryomilling process.

The degassing process may include one or more degassing process parameters, such as a degassing pressure, a degassing temperature, and a degassing time. The degassing process may be performed by any suitable degassing apparatus operating under the degassing process parameters. For example, the cryomilled metallic material powder may be degassed at the degassing temperature and under the degassing pressure for a period of time (e.g., the degassing time). The degassing process may be performed using a commercially available degassing machine.

In one realization, the degassing temperature (in degrees Kelvin) may be a function of the melting temperature $T_M$ (in degrees Kelvin) of the metallic material powder. As one example, the degassing temperature may range from about 30 to about 50 percent of the melting temperature $T_M$ of the metallic material powder. As another example, the degassing temperature may range from about 50 to about 70 percent of $T_M$. As another example, the degassing temperature may range from about 70 to about 90 percent of $T_M$. As yet another example, the degassing temperature may range from about 30 to about 90 percent of $T_M$.

In one example implementation, the degassing pressure may be less than or equal to $10^{-6}$ torr. In another example implementation, the degassing pressure may be less than or equal to $5\times10^{-6}$ torr.

In one example implementation, the degassing time may be less than or equal to 4 hours. In another example implementation, the degassing time may be less than or equal to 12 hours. In yet another example implementation, the degassing time may be less than or equal to 24 hours. Degassing for over 24 hours is also contemplated.

Additionally, the degassing temperature and/or the degassing pressure may be slowly ramped up to a first degassing temperature and held for a first period of time and then slowly ramped up to a second degassing temperature and held for a second period of time. Additional ramped degassing temperatures and holding times are also contemplated.

Optionally, the degasing temperature and degassing pressure may vary over the degassing time (e.g., one or more degassing stages). For example, at a first stage the cryomilled metallic material powder may be degassed at a lower degassing temperature, at a second stage the cryomilled metallic material powder may be degassed at a higher degassing temperature, and at a third stage the cryomilled metallic material powder may be degassed at an even higher degassing temperature.

As shown at block 28, the degassed metallic material powder (e.g., the degassed aluminum alloy powder) may be subjected to a consolidating process configured to form the semifinished metallic billet (e.g., the semifinished aluminum alloy billet). As one example, the degassed metallic material powder may be subjected to a hot isostatic pressing ("HIP") process to form the semifinished metallic billet having a nanocrystalline and/or ultrafine-grained microstructure. Other examples of suitable consolidation processes include, but are not limited to, cold isostatic pressing, hot or cold explosive compaction, cold spray and the like.

The HIP consolidating process may include one or more consolidating process parameters, such as a consolidating pressure, a consolidating temperature, and a consolidating time. The HIP consolidating process may be performed by any suitable hot isostatic pressing apparatus operating under the consolidating process parameters. For example, the degassed metallic material powder may be consolidated at the consolidating temperature and under the consolidating pressure for a period of time (e.g., the consolidating time). The consolidating process may be performed using a commercially available hot isostatic pressing machine.

In one realization, the HIP consolidating temperature may be a function of the melting temperature $T_M$ (in degrees Kelvin) of the metallic material powder. As one example, the consolidating temperature may range from about 30 to about 50 percent of the melding temperature $T_M$ of the metallic material powder. As another example, the consolidating temperature may range from about 50 to about 70 percent of $T_M$. As another example, the consolidating temperature may range from about 70 to about 90 percent of $T_M$. As yet another example, the consolidating temperature may range from about 30 to about 90 percent of $T_M$.

In one example implementation, the HIP consolidating pressure may be greater than or equal to 3,000 psi. In another example implementation, the consolidating pressure may be greater than or equal to 7,000 psi. In another example implementation, the consolidating pressure may be greater than or equal to 15,000 psi. In another example implementation, the consolidating pressure may be greater than or equal to 25,000 psi. In yet another example implementation, the consolidating pressure may be greater than or equal to 35,000 psi.

In one example implementation, the consolidating time may be less than or equal to 2 hours. In another example implementation, the consolidating time may be less than or equal to 4 hours. In another example implementation, the consolidating time may be less than or equal to 12 hours. In yet another example implementation, the consolidating time may be less than or equal to 24 hours. Consolidating times in excess of 24 hours are also contemplated.

EXAMPLE

UHP 6061 Aluminum Alloy

Figure 3:
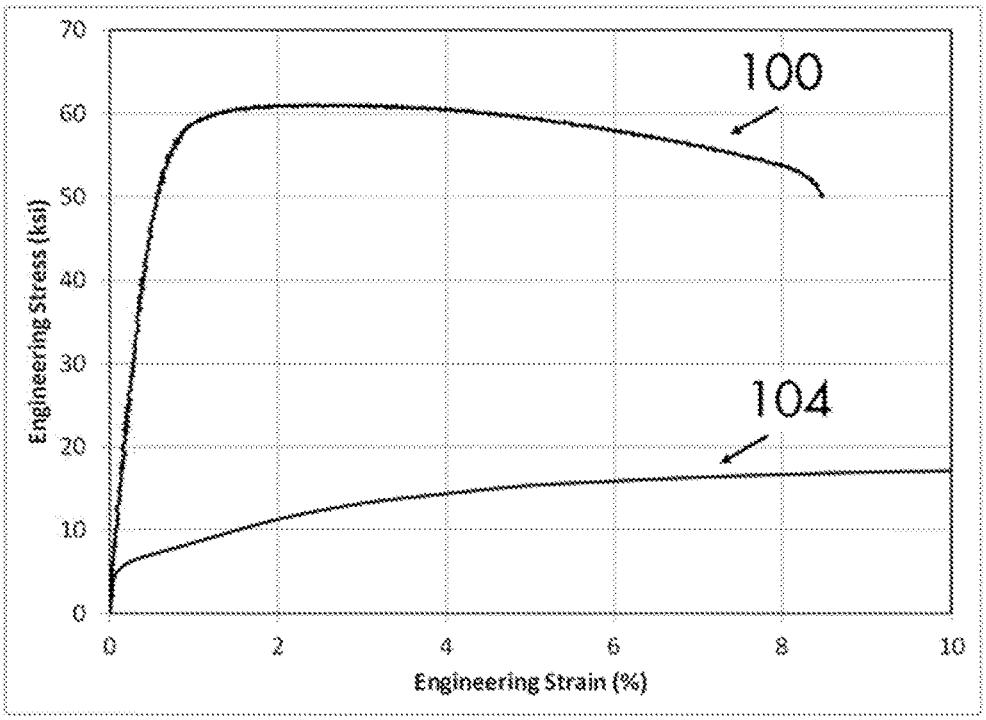
FIG. 3 is an illustration of a stress versus strain curve comparing the deformation behavior and strength of an example ultrahigh performance 6061 aluminum alloy to a conventional 6061 aluminum alloy, both in the same annealed condition.

FIG. 3 compares a stress versus strain curve of an example ultrahigh performance 6061-O aluminum alloy product 100 to a stress versus strain curve of a conventional micrograined 6061-O aluminum alloy product 104. Both the example alloy and the conventional micrograined (comparative) alloy were in the same annealed condition for comparison. The plot in FIG. 3 shows tensile yield strength has improved approximately 850 percent in the UHP 6061-O aluminum alloy product compared to the conventional micrograined 6061-O aluminum alloy product.

Production of the example ultrahigh performance 6061-O aluminum alloy product 100 used in FIG. 3 began with a metallic material powder, specifically a commercial atomized alloy powder, having the following composition: 1.0 percent by weight magnesium; 0.6 percent by weight silicon; 0.25 percent by weight copper; 0.20 percent by weight chromium; and the balance aluminum.

The metallic material powder was subjected to a cryomilling process to produce a cryomilled metallic material powder having an ultrafine-grained microstructure. The cryomilling process was conducted using a modified 01-HD attritor obtained from Union Process, Inc., with a stainless steel milling arm, stainless steel vial and liquid nitrogen (cryogenic temperature of about −375° F.). Stainless steel milling balls were used and the ball-to-powder ratio was about 30:1. Additionally, about 0.2 percent by weight of stearic acid was added to the metallic material powder. The attrition speed was about 180 rpm and the milling time was about 8 hours.

The cryomilled metallic material powder was subjected to a hot vacuum degassing process to produce a degassed metallic material powder having an ultrafine-grained microstructure. The degassing process was performed for about 24 hours, with a degassing pressure ranging up to about $10^{-6}$ torr and a degassing pressure ranging up to about 750° F. (with slow temperature ramps and holds).

The degassed metallic material powder was subjected to a HIP (hot isostatic pressing) consolidation process to produce a semifinished metallic billet having an ultrafine-grained microstructure. The HIP consolidation temperature was about 970° F. and the HIP consolidation pressure was about 15 ksi. HIP consolidation time was about 2 hours.

The semifinished metallic billet was subjected to a swaging process (a rotary incremental forming process) to produce an intermediate wrought metallic billet having an ultrafine-grained microstructure. The swaging process was performed at a temperature of about 400° F. with an average equivalent strain rate of about 0.01 $s^{-1}$ to 1 $s^{-1}$. The swaging area reduction (initial/final area) was about 4:1 in 10 passes.

The intermediate wrought metallic billet was subjected to an extrusion process (a high rate forming process) to produce the example ultrahigh performance 6061-O aluminum alloy product 100 used in FIG. 3. The extrusion process was performed at ambient temperature with an average equivalent strain rate ranging from about 10 $s^{-1}$ to about 1,000 $s^{-1}$. The extrusion area reduction (initial/final area) was about 5:1 in one pass.

Accordingly, the disclosed method may include the specific thermomechanical processing of semifinished nanocrystalline and/or ultrafine-grained metallic billets required to produce high performance and ultrahigh performance wrought products having an increased yield strength and similar ductility compared to conventional micrograined products with similar chemical compositions.

Although various embodiments of the disclosed method for production of metallic materials have been shown and described, modifications may occur to those skilled in the art upon reading the specification. The present application includes such modifications and is limited only by the scope of the claims.

What is claimed is:

1. A method for production of metallic material from a semifinished metallic billet, said semifinished metallic billet comprising at least one of a nanocrystalline microstructure and an ultrafine-grained microstructure, said method comprising:

subjecting said semifinished metallic billet to a rotary incremental forming process to form an intermediate wrought metallic billet; and subjecting said intermediate wrought metallic billet to a high rate forming process, wherein said high rate forming process comprises a high rate forming process average equivalent strain rate, said high rate forming process average equivalent strain rate being at least about 0.1 $s^{-1}$.

2. The method of claim 1 wherein said rotary incremental forming process comprises a rotary swaging process.

3. The method of claim 1 wherein said high rate forming process comprises an extrusion process.

4. The method of claim 1 wherein said rotary incremental forming process comprises a rotary incremental forming process temperature (in degrees Kelvin), said rotary incremental forming process temperature being at most about 90 percent of a melting temperature (in degrees Kelvin) of said semifinished metallic billet.

5. The method of claim 4 wherein said high rate forming process comprises a high rate forming process temperature (in degrees Kelvin), said high rate forming process temperature being at most about 90 percent of said melting temperature (in degrees Kelvin) of said semifinished metallic billet.

6. The method of claim 5 wherein said high rate forming process temperature is less than said rotary incremental forming process temperature.

7. The method of claim 1 wherein said rotary incremental forming process comprises a rotary incremental forming process average equivalent strain rate, said rotary incremental forming process average equivalent strain rate being at most about 100 $s^{-1}$.

8. The method of claim 1 wherein said high rate forming process average equivalent strain rate is greater than said rotary incremental forming process average equivalent strain rate.

9. The method of claim 1 further comprising:

providing a metallic material powder;

subjecting said metallic material powder to a cryomilling process to form a cryomilled metallic material powder comprising said microstructure; and subjecting said cryomilled metallic material powder to a consolidating process to form said semifinished metallic billet comprising said microstructure.

10. The method of claim 9 wherein said consolidating process comprises:

a consolidating temperature, said consolidating temperature ranging from about 30 percent to about 90 percent of a melting temperature (in degrees Kelvin) of said metallic material powder; and a consolidating pressure, said consolidating pressure being at least 3,000 psi.

11. The method of claim 9 further comprising subjecting said cryomilled metallic material powder to a degassing process before subjecting said cryomilled metallic material powder to said consolidating process.

12. The method of claim 11 wherein said degassing process comprises a degassing temperature, said degassing temperature ranging from about 30 percent to about 90 percent of a melting temperature (in degrees Kelvin) of said metallic material powder.

13. The method of claim 1 wherein said high rate forming process comprises a high rate forming process temperature (in degrees Kelvin), said high rate forming process temperature being at most about 90 percent of a melting temperature (in degrees Kelvin) of said semifinished metallic billet.

14. The method of claim 1 wherein said high rate forming process comprises a high rate forming process temperature (in degrees Kelvin), said high rate forming process temperature being at most about 60 percent of a melting temperature (in degrees Kelvin) of said semifinished metallic billet.

15. The method of claim 1 wherein said high rate forming process comprises a high rate forming process temperature (in degrees Kelvin), said high rate forming process temperature being at most about 40 percent of a melting temperature (in degrees Kelvin) of said semifinished metallic billet.

16. The method of claim 1 wherein said high rate forming process comprises a high rate forming process temperature (in degrees Kelvin), said high rate forming process temperature being at most about 20 percent of a melting temperature (in degrees Kelvin) of said semifinished metallic billet.

17. A method for production of a metallic material from a metallic material powder, said method comprising:

subjecting said metallic material powder to a cryomilling process to form a cryomilled metallic material powder comprising at least one of a nanocrystalline microstructure and an ultrafine-grained microstructure;

subjecting said cryomilled metallic material powder to a degassing process to form a degassed metallic material powder;

subjecting said degassed metallic material powder to a consolidating process to form a semifinished metallic billet, said semifinished metallic billet comprising at least one of the nanocrystalline microstructure and the ultrafine-grained microstructure;

subjecting said semifinished metallic billet to a rotary incremental forming process to form an intermediate wrought metallic billet; and subjecting said intermediate wrought metallic billet to a high rate forming process, wherein said high rate forming process comprises a high rate forming process average equivalent strain rate, said high rate forming process average equivalent strain rate being at least about 0.1 $s^{-1}$.

18. The method of claim 17 wherein said metallic material powder comprises at least one of aluminum, aluminum alloy, titanium, titanium alloy, iron-based alloy, nickel, nickel alloy, cobalt, cobalt alloy, magnesium, magnesium alloy, copper, copper alloy, a precious metal, a precious metal alloy, zinc, zinc alloy, zirconium, zirconium alloy, hafnium, hafnium alloy, an intermetallic, and a metal matrix material.

19. The method of claim 17 wherein said rotary incremental forming process comprises a rotary incremental forming process temperature, said rotary incremental forming process temperature being at most about 90 percent of a melting temperature (in degrees Kelvin) of said semifinished metallic billet.

20. The method of claim 17 wherein said high rate forming process comprises a high rate forming process temperature, said high rate forming process temperature being at most about 90 percent of a melting temperature (in degrees Kelvin) of said semifinished metallic billet.

21. The method of claim 17 wherein said metallic material powder comprises at least one of a refractory metal and a refractory alloy.

22. A method for production of an aluminum alloy from a semifinished aluminum alloy billet, said semifinished aluminum alloy billet comprising at least one of nanocrystalline microstructure and an ultrafine-grained microstructure, said method comprising:

subjecting said semifinished aluminum alloy billet to a rotary swaging process to form an intermediate wrought aluminum alloy billet, wherein said rotary swaging process comprises a rotary swaging temperature, said rotary swaging temperature being greater than ambient temperature and less than 90 percent of a melting temperature (in degrees Kelvin) of said semi-finished aluminum alloy billet; and subjecting said intermediate wrought aluminum alloy billet to a high rate extrusion process, wherein said high rate extrusion process comprises a high rate extrusion process average equivalent strain rate, said high rate extrusion process average equivalent strain rate being at least about 0.1 $s^{-1}$.

23. The method of claim 22 wherein said high rate extrusion process is performed at ambient temperature.

* * * * *